United States Patent [19]

Mammel

[11] 4,002,389

[45] Jan. 11, 1977

[54] SELF LATCHING AND UNLATCHING CONNECTOR ASSEMBLY

[75] Inventor: Lewis Howard Mammel, Holmdel, N.J.

[73] Assignee: Bell Telephone Laboratories, Incorporated, Murray Hill, N.J.

[22] Filed: July 11, 1975

[21] Appl. No.: 595,224

[52] U.S. Cl. ..... 339/91 R; 339/103 M; 339/208

[51] Int. Cl.[2] ..... H01R 13/54; H01R 13/58

[58] Field of Search ..... 339/75 R, 75 M, 91 R, 339/103 R, 103 M, 107, 176 M, 206 R, 208

[56] References Cited

UNITED STATES PATENTS

| | | | |
|---|---|---|---|
| 3,097,033 | 7/1963 | Felts | 339/75 R |
| 3,711,816 | 1/1973 | Schumacher | 339/91 R |
| 3,784,961 | 1/1974 | Gartland | 339/107 |
| 3,810,073 | 5/1974 | Zajac et al. | 339/91 R |
| 3,904,265 | 9/1975 | Hollyday et al. | 339/103 M |

FOREIGN PATENTS OR APPLICATIONS

| | | | |
|---|---|---|---|
| 1,465,642 | 4/1969 | Germany | 339/91 R |
| 1,048,230 | 11/1966 | United Kingdom | 339/91 R |

*Primary Examiner*—Roy Lake
*Assistant Examiner*—E. F. Desmond
*Attorney, Agent, or Firm*—Charles Scott Phelan; A. E. Hirsch, Jr.

[57] ABSTRACT

A self latching and unlatching connector assembly includes first and second connectors having mating electrical contacts. The first connector has affixed thereto a pair of latch members. The second connector is mounted in an assembly which includes upper and lower shell halves, each of which has a groove therein for engaging a mounting flange on the connector. A pair of levers, each having first and second arms, are mounted on a pair of pivots which are integral with the lower shell half. One arm of each of these levers engages one of a pair of spring latches, each of which has provision at one end thereof for latching the second connector assembly to the first connector latch members. A sleeve having a pair of locking pins affixed thereto fits over the two mated shell halves. To effect disconnection the sleeve is grasped at any position on its periphery and pulled. The pulling force on the sleeve is transferred via the locking pins to the levers which, in turn, transfer the force to the spring latches causing them to unlatch from the latch members.

16 Claims, 5 Drawing Figures

SELF LATCHING AND UNLATCHING CONNECTOR ASSEMBLY

BACKGROUND OF THE INVENTION

1. Field of the Invention

This invention relates to electrical connector assemblies and, in particular, to a connector assembly that has self latching and unlatching capability.

2. Description of the Prior Art

In many instances an electrical connection between one piece of equipment, such as a data set, and another piece of equipment, such as customer terminal equipment, is susceptible to accidental disconnection by virtue of someone tripping over the interconnection cable. This problem can be circumvented by securely fastening the two matching electrical connectors together, but this requires the use of additional tools and hardware, or the allocation of additional space so the mating connectors can be grasped at an appropriate position to effect disconnection. In most cases the former approach is unsatisfactory since the necessary tools and hardware are not always readily available. The latter approach proves unacceptable in those cases where the amount of space available for making the connection is limited.

Accordingly, it is one object of the present invention to significantly reduce the possiblity of accidental disconnections.

Another object is to provide a secure connection between a pair of mating electrical connectors without the use of special tools or additional mounting hardware.

A further object of the present invention is to configure a connector assembly which can be advantageously securely latched to a mating connector and unlatched therefrom without having a grasp particular positions on the connector assembly.

Still a further object is to reduce the amount of space required to provide a latched connection and, in turn, increase the number of connector contacts which may be accommodated within the space available.

SUMMARY OF THE INVENTION

The foregoing and other objects of the invention are realized in an illustrative embodiment wherein an electrical connector assembly includes first and second connectors adapted for effecting an electric circuit closure upon bringing the connectors together. The second connector has means for latching it to the first connector to prevent separation in response to inappropriate separation forces applied to the connectors. The connector assembly further includes means for coupling an appropriate disconnection force to the second connector. The coupling means includes means for transferring to the latching means a sufficient part of the disconnection force applied through the coupling means to unlatch the connectors and thereby permit separation of the connectors in response to the disconnection force.

Accordingly, it is one feature of the present invention that the two connectors are latched together automatically when one connector is mated with the other connector.

Another feature is that the two connectors can be advantageously unlatched by applying a disconnection force to a sleeve assembly enclosing a mounting assembly for the second connector at any point on its periphery, but the two connectors cannot be unlatched by a disconnection force applied to a cable terminated by the second connector.

A further feature of the present invention is that the first connector has a pair of latch members affixed thereto.

Still another feature is that the second connector is affixed to the mounting assembly by means of a connector mounting flange which engages grooves in the mounting assembly.

Yet another feature of the present invention is that the connector mounting assembly includes provision for routing a cable to electrical contacts in the second connector at an angle of approximately 30 degrees, thereby reducing the amount of space needed to externally route the cable in different directions.

Still a further feature is that the latching of the second connector to the first connector is effected by first and second spring latches which are included in the connector mounting assembly.

Yet a further feature of the present invention is that the spring latches advantageously engage a lip on the latch members affixed to the first connector.

BRIEF DESCRIPTION OF THE DRAWINGS

The aforementioned objects and features of the invention, as well as other objects and features, will be better understood upon a consideration of the following detailed description and the appended claims in connection with the attached drawings of an illustrative embodiment in which:

DETAILED DESCRIPTION

Figure 1:
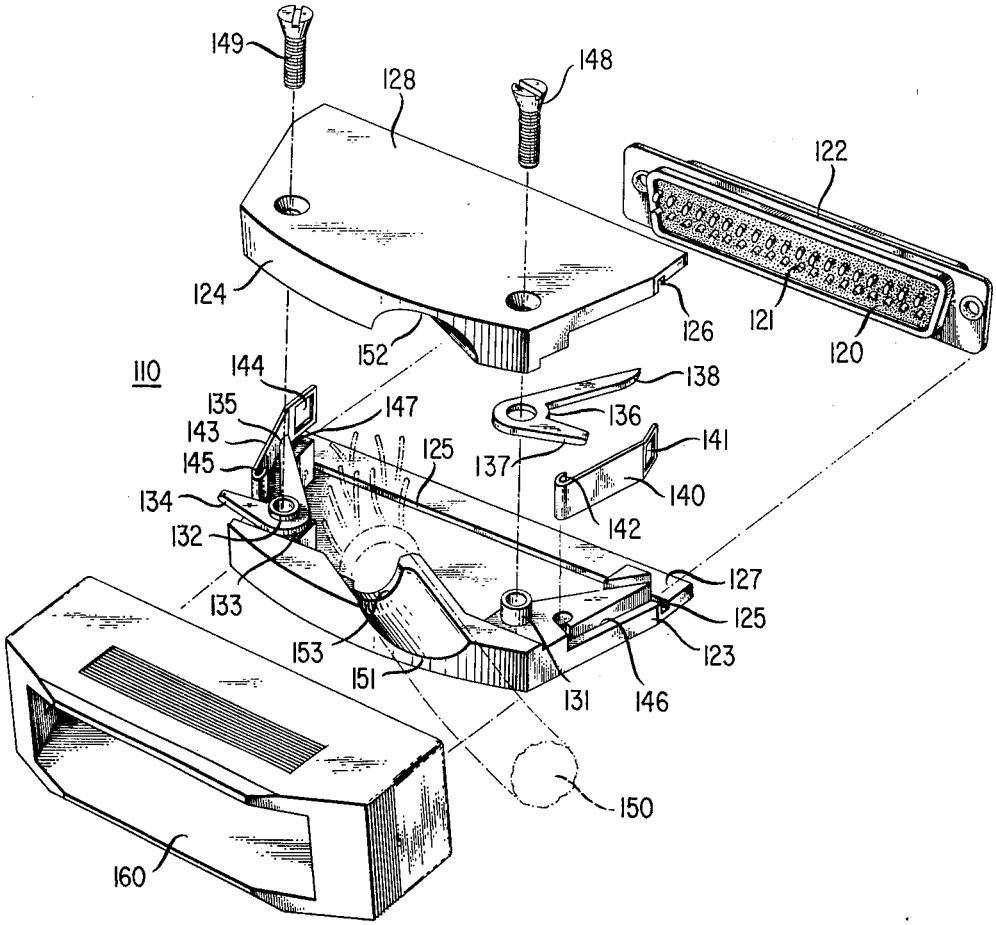
FIG. 1 is an exploded view of the connector mounting assembly.
Figure 2:
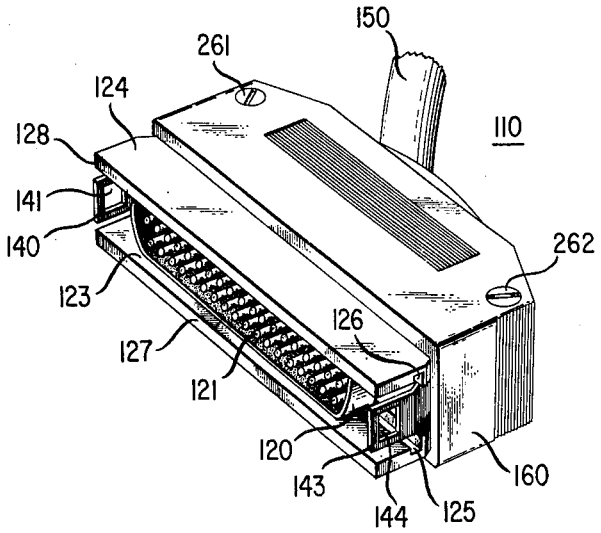
FIG. 2 is a perspective view of an assembled connector mounting assembly.

A connector mounting assembly 110, shown in the exploded view of FIG. 1 and the assembled prospective view of FIG. 2, is used for the implementation of several functions. First, the connector mounting assembly 110 includes provision for mounting a first electrical connector 120. Second, the connector mounting assembly 110 includes mechanical apparatus for latching it to and unlatching it from a second connector 310, shown in FIG. 3. Third, the connector mounting assembly 110 has provision therein for routing a sheathed cable 150, at an angle of approximately 30 degrees, to a plurality of electrical contacts 121 in the connector 120 in order to reduce the amount of space needed to externally route the cable 150 in different directions.

Figure 3:
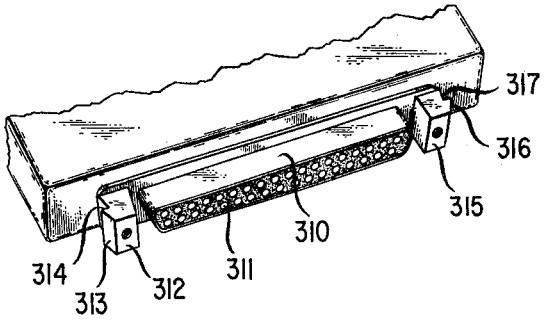
FIG. 3 illustrates a connector having latch members affixed thereto.

Mounting the electrical connector 120 in the connector mounting assembly 110 is effected in the following manner. The connector 120, as shown in FIG. 1, has integral therewith a mounting flange 122 which encircles it. Mounting flange 122 which lies in a plane perpendicular to first and second parallel planes containing the electrical contacts 121. The mounting flange 122 engages a first groove 125 in a lower shell half 123 and a second groove 126 in an upper shell half 124. Each of the grooves 125 and 126 extends in a lengthwise direction parallel with corresponding shell half end faces 127 and 128. Shell half end faces 127 and 128 are, in turn, parallel with the connector 310, as shown in FIG. 3, when the connector 120 is mated therewith. Grooves 125 and 126 each have a width which is at least equal to a width of the mounting flange 122. When the upper shell half 124 is affixed to the lower shell half 123 by a pair of screws 148 and 149, the connector 120 is securely held in place.

Latching of the connector mounting assembly 110 to the connector 310 is effected by a pair of spring latches 140 and 143 engaging latch members 312 and 315 affixed to connector 310, as shown in FIG. 3. Spring latches 140 and 143 are secured to the lower shell half 123 by the insertion of hooked ends 142 and 145 into similar shaped mounting grooves 146 and 147, respectively. Corresponding mounting grooves (not shown) are included in the upper shell half 124. When the lower and upper shell halves 123 and 124 are fastened together by screws 148 and 149, spring latches 140 and 143 are securely held in position.

It should be noted that the cable 150 connects to the electrical contacts 121 and that the contacts 121 extend through an opposite side of connector 120 (in a way not shown) to engage a plurality of electrical contacts 311 in connector 310. As the contacts 121 in connector 120 engage contacts 311 in connector 310, spring latches 140 and 143 engage the latch members 315 and 312, respectively. Latch member 312 includes a side face 313 which terminates in a lip 314. Correspondingly, latch member 315 includes a side face 316 which terminates in a lip 317. The side faces 313 and 316 have a generally divergent taper when connector 310 is viewed from the connector mounting assembly 110. Side faces 313 and 316 cause the spring latches 143 and 140 to deflect outwardly from a plane perpendicular to a plane connecting shell half end faces 127 and 128. This outward deflection continues until rectangular apertures 141 and 144 reach lips 317 and 314, respectively, on latch members 315 and 312. At this point the outward deflection ceases and spring latches 140 and 143 engage the latch members 315 and 312 securely fastening the connector mounting assembly 110 to connector 310.

Figure 4:
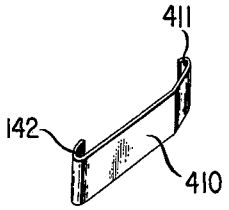
FIG. 4 illustrates an alternate embodiment of the latching mechanism utilized by the spring latches.

An alternate embodiment of the spring latch 140, for example, is illustrated by a spring latch 410, shown in FIG. 4. Spring latch 410 is identical in all respects to spring latch 140 except the rectangular aperture 141 is eliminated and a hook-shaped bend 411 on the end of the spring latch 410 is substituted therefor. The latching effected by spring latch 410 is similar to that of spring latch 140 except the hook-shaped bend 411 engages the lip 317 of latch member 315. It should be noted that a spring latch similar to spring latch 410 would be substituted for spring latch 143 in the alternate embodiment.

Figure 5:
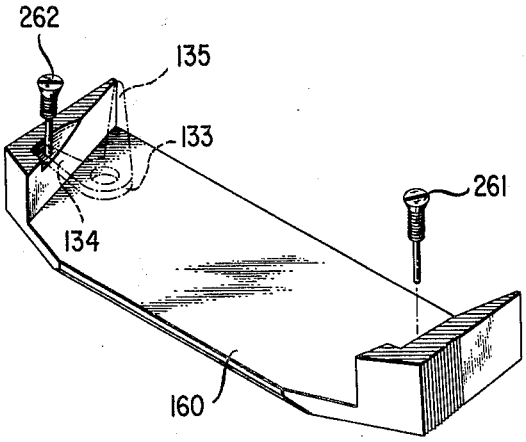
FIG. 5 is a sectional view of a sleeve assembly.

Unlatching the connector mounting assembly 110 from the latch members 312 and 315 of connector 310 is effected by applying a disconnection force to a sleeve assembly 160, as shown in FIG. 1, at any point on its periphery. The sleeve assembly 160, shown in a sectional view in FIG. 5, fits over the upper and lower shell halves 124 and 123 when they are attached to one another. Affixed to the sleeve assembly 160 are a pair of locking pins 261 and 262, which are shown in more detail in the sectional view of FIG. 5. The locking pins 261 and 262 lie in first and second parallel planes which are perpendicular to a plane containing the upper shell half 124. Locking pins 261 and 262 attach to the sleeve assembly 160 at a point between arms 134 and 135 of a lever 133 and arms 137 and 138 of a lever 136.

When the disconnection force is applied to the sleeve assembly 160, the locking pins 261 and 262 engage arms 137 and 134 of levers 136 and 133, respectively, the latter being pivotally mounted on the lower shell half 123 by pivots 131 and 132. Continued application of the disconnection force to the sleeve assembly 160 causes levers 133 and 136 to rotate about pivots 131 and 132 bringing lever arms 135 and 138 into contact with spring latches 143 and 140. Lever arms 135 and 138 deflect spring latches 143 and 140 outwardly from the body of connector mounting assembly 110 disengaging the rectangular apertures 144 and 141 from latch members 312 and 315.

The disconnection force required to effect the release of the connector mounting assembly 110 from latch members 312 and 315 must exceed the spring force developed by the spring latches 140 and 143 when the latter force is scaled by the ratio of the length of lever arm 135 to the length of lever arm 134. This relationship may be stated in equation form as:

$$F_D > 2F_S L_L/L_S,$$

where $F_D$ represents the disconnection force, $F_S$ represents the spring force, $L_L$ represents the length of lever arm 135 and $L_S$ represents the length of lever arm 134. The factor of 2 arises because two spring latches 140 and 143 are utilized. The necessity of having the disconnection force exceed the spring force is to ensure the disengagement of spring latches 140 and 143 from latch members 312 and 315 before the connector mounting 110 is withdrawn.

As noted previously, the connector mounting assembly 110 also has provision therein for routing the sheathed cable 150 at an angle to the plurality of electrical contacts 121 in connector 120. By routing the cable 150 at an angle of approximately 30 degrees the need to provide alternate assemblies for cable routing is circumvented. Moreover, the overall space required for a completed connection is reduced since the angular routing advantageously allows the cable 150 to emerge from the connector mounting assembly 110 with only a slight bend therein and this allows cable 150 to be externally routed adjacent to the body of connector mounting assembly 110.

The angular cable routing is effected by a pair of semicircular channels 151 and 152 in shell halves 123 and 124. Each of the channels 151 and 152 extends in a lengthwise direction for a predetermined distance. If channels 151 and 152 were extended they would intersect the shell half end faces 127 and 128 at the approximate angle noted. Channels 151 and 152 have a radius of curvature which is approximately equal to the radius of curvature of the sheathed cable 150. The lengthwise extent of channel 151 is limited by a crimping edge 153 shown in FIG. 1. A corresponding crimping edge (not shown) is included in the upper shell half 124. Crimping edge 153 has a radius of curvature approximately equal to the radius of curvature of the cable 150 with its sheath removed. When the cable 150 is placed between the channels 151 and 152 the crimping edges engage the cable sheath thereby securing the cable 150 to the connector mounting assembly 110.

In all cases it is to be understood that the above-described embodiment is illustrative of but a small number of many possible specific embodiments which can represent applications of the principles of the invention. Thus, numerous and various other embodiments can readily be devised in accordance with these principles by those skilled in the art without departing from the spirit and scope of the invention.

What is claimed is:

1. An electrical connector assembly including:

first and second connectors having mating electrical contacts, said first connector having affixed thereto a pair of barbed latch members; and a connector mounting assembly, said connector mounting assembly including;

means for securing said second connector to said connector mounting assembly;

first and second leaf springs each having one end affixed to said connector mounting assembly;

means, integral with an opposite end of each of said leaf springs, for latching said connector mounting assembly to said pair of barbed latch members upon engagement of said first and second connectors;

first and second pivotable levers, each lever having a pair of arms connected together at a predetermined angle; and a sleeve assembly enclosing said connector mounting assembly, said sleeve assembly including first and second locking pins for engaging one arm of each of said levers as a disconnection force is applied to said sleeve assembly at any point on its periphery, the other arm of each of said levers engaging said first and second leaf springs at a point adjacent said latching means thereby deflecting said leaf spring latching means outwardly away from said pair of barbed latch members and releasing said connector mounting assembly from said first connector barbed latch members.

2. The electrical connector assembly in accordance with claim 1 wherein the connector mounting assembly includes:

upper and lower mating shell halves;

means, included in said shell halves, for engaging a mounting flange encircling said second connector, said mounting flange lying in a plane perpendicular to first and second parallel planes containing said mating electrical contacts;

means, included in said shell halves, for routing a sheathed cable to said second connector electrical contacts; and means for affixing said upper shell half to said lower shell half.

3. The electrical connector assembly in accordance with claim 2 wherein the means, included in said shell halves, for engaging a mounting flange encircling said second connector includes:

first and second grooves in said upper and lower shell halves, respectively, said grooves extending in a lengthwise direction parallel with corresponding end faces of said upper and lower shell halves, said end faces being parallel with said first and second connectors when said connectors are mated, said grooves having a width at least equal to a width of said second connector mounting flange.

4. The electrical connector assembly in accordance with claim 2 wherein the means, included in said shell halves, for routing a sheathed cable to said second connector electrical contacts includes:

first and second semicircular channels in said upper and lower shell halves, respectively, said channels extending in a lengthwise direction for a predetermined distance, the lengthwise extent of said channels, when extended, intersecting corresponding end faces of said upper and lower shell halves at a predetermined angle, said end faces being parallel with said first and second connectors when said connectors are mated, said channels having a radius of curvature at least equal to a radius of curvature of said sheathed cable; and first and second crimping edges for limiting the lengthwise extent of said first and second channels, respectively, each of said crimping edges having a radius of curvature approximately equal to a radius of curvature of said cable without its sheath, said crimping edges engaging said cable sheath to secure said cable to said connector mounting assembly.

5. The electrical connector assembly in accordance with claim 1 wherein the means for latching said connector mounting assembly to said pair of first connector barbed latch members includes:

first and second generally rectangular apertures located adjacent a free end of said first and second leaf springs, respectively, and lying in first and second parallel planes which are perpendicular to a plane containing said pair of barbed latch members.

6. The electrical connector assembly in accordance with claim 1 wherein the means for latching said connector mounting assembly to said pair of first connector barbed latch members includes:

first and second oppositely directed hook-shaped bends located on a free end of said first and second leaf springs, respectively, and lying in first and second parallel planes which are perpendicular to a plane containing said pair of barbed latch members.

7. The electrical connector assembly in accordance with claim 1 wherein said first and second locking pins lie in first and second planes perpendicular to a plane containing said first and second levers, said locking pins being affixed to said sleeve assembly at a point between said pair of arms of said first and second levers.

8. The electrical connector assembly in accordance with claim 1 wherein:

said disconnection force to effect the release of said connector mounting assembly from said first connector latch members exceeds a spring force developed by said first and second leaf spring latches scaled by a ratio of a length of said second arm of said pair of arms of said first and second levers to a length of said first arm of said pair of arms.

9. An electrical connector assembly including:

first and second connectors having mating electrical contacts, said first connector having affixed thereto first and second latch members; and a connector mounting assembly having provision for affixing thereto said second connector, said connector mounting assembly including;

first and second cantilever-mounted leaf spring latches, each having provision therein at a free end for engaging said first connector first and second latch members, respectively;

first and second pivotable levers, each lever having a pair of arms connected together at a predetermined angle; and a sleeve assembly enclosing said connector mounting assembly, said sleeve assembly including first and second locking pins, said locking pins engaging one arm of each of said levers as a disconnection force is applied to said sleeve assembly, the other arm of each of said levers engaging said first and second spring latches thereby uncoupling said spring latches from said first connector first and second latch members.

10. The electrical connector assembly in accordance with claim 9 wherein:

said disconnection force to effect the release of said connector mounting assembly from said first connector latch members exceeds a spring force developed by said first and second spring latches scaled by a ratio of a length of said second arm of said pair of arms of said first and second levers to a length of said first arm of said pair of arms.

11. The electrical connector assembly in accordance with claim 9 wherein the provision for affixing the second connector to the connector mounting assembly includes:

upper and lower mating shell halves; and first and second grooves in said upper and lower shell halves, respectively, said grooves extending in a lengthwise direction parallel with corresponding end faces of said upper and lower shell halves, said end faces being parallel with said first and second connectors when said connectors are mated, said grooves having a width at least equal to a width of a mounting flange encircling said second connector, said mounting flange lying in a plane perpendicular to first and second parallel planes containing said mating electrical contacts.

12. The electrical connector assembly in accordance with claim 11 further including:

means, included in said shell halves, for routing a sheathed cable to said second connector electrical contacts, said routing means including;

first and second semicircular channels in said upper and lower shell halves, respectively, said channels extending in a lengthwise direction for a predetermined distance, the lengthwise extent of said channels, when extended, intersecting corresponding end faces of said upper and lower shell halves at a predetermined angle, said end faces being parallel with said first and second connectors when said connectors are mated, said channels having a radius of curvature at least equal to a radius of curvature of said sheathed cable; and first and second crimping edges for limiting the lengthwise extent of said first and second channels, respectively, each of said crimping edges having a radius of curvature approximately equal to a radius of curvature of said cable without its sheath, said crimping edges engaging said cable sheath to secure said cable to said connector mounting assembly.

13. An electrical connector assembly including:

first and second connectors having mating electrical contacts, said first connector having affixed thereto a pair of barbed latch members; and a connector mounting assembly, said connector mounting assembly including;

upper and lower mating shell halves;

first and second grooves in said upper and lower shell halves, respectively, for engaging a mounting flange encircling said second connector, said mounting flange lying in a plane perpendicular to first and second parallel planes containing said mating electrical contacts and said grooves extending in a lengthwise direction parallel with corresponding end faces of said upper and lower shell halves, said end faces being parallel with said first and second connectors when said connectors are mated, said grooves further having a width at least equal to a width of said second connector mounting flange;

first and second leaf springs each having one end affixed between said upper and lower shell halves at a point intermediate a side face of said shell halves;

means, integral with a free end of each of said leaf springs, for latching said connector mounting assembly to said pair of first connector barbed latch members upon engagement of said first and second connector mating contacts;

first and second pivotable levers, each lever having a pair of arms connected together at a predetermined angle; and a sleeve assembly enclosing said connector mounting assembly, said sleeve assembly including first and second locking pins for engaging one arm of each of said levers as a disconnection force is applied to said sleeve assembly at any point on its periphery, the other arm of each of said levers engaging said first and second leaf springs at a point adjacent said free end thereby deflecting said leaf spring latching means outwardly away from said pair of barbed latch members and releasing said connector mounting assembly from said first connector barbed latch members.

14. The electrical connector assembly in accordance with claim 13 wherein the means for latching said connector mounting assembly to said pair of first connector barbed latch members includes:

first and second generally rectangular apertures positioned adjacent free ends of said first and second leaf springs, respectively, and lying in first and second parallel planes which are perpendicular to a plane containing said pair of first connector barbed latch members.

15. The electrical connector assembly in accordance with claim 13 wherein the means for latching said connector mounting assembly to said pair of first connector barbed latch members includes:

first and second oppositely directed hook-shaped bends positioned adjacent free ends of said first and second leaf springs, respectively, and lying in first and second parallel planes which are perpendicular to a plane containing said pair of first connector barbed latch members.

16. The electrical connector assembly in accordance with claim 13 wherein said upper and lower shell halves include:

first and second semicircular channels, respectively, for routing a sheathed cable to said second connector electrical contacts, said channels extending in a lengthwise direction for a predetermined distance, the lengthwise extent of said channels, when extended, intersecting corresponding end faces of said upper and lower shell halves at a predetermined angle, said end faces being parallel with said first and second connectors when said connectors are mated, said channels having a radius of curvature at least equal to a radius of curvature of said sheathed cable; and first and second crimping edges for limiting the lengthwise extent of said first and second channels, respectively, each of said crimping edges having a radius of curvature approximately equal to a radius of curvature of said cable without its sheath, said crimping edges engaging said cable sheath to secure said cable to said connector mounting assembly.

* * * * *